United States Patent [19]

Sutter

[11] 4,371,269

[45] Feb. 1, 1983

[54] D-C VOLTAGE CONVERTER FOR A WRISTWATCH

[75] Inventor: Hans-Rudolf Sutter, Pieterlen, Switzerland

[73] Assignee: Bulova Watch Co., Inc., Flushing, N.Y.

[21] Appl. No.: 185,493

[22] Filed: Sep. 9, 1980

[51] Int. Cl.[3] ..... G04C 10/04

[52] U.S. Cl. ..... 368/205; 368/204; 368/66; 368/219; 363/25; 320/2

[58] Field of Search ..... 368/205, 204, 66, 80, 368/218, 219; 363/25, 26, 127, 97; 320/2; 307/582, 269, 297, 127

[56] References Cited

U.S. PATENT DOCUMENTS

| | | | |
|---|---|---|---|
| 3,701,937 | 10/1972 | Combs | 363/25 |
| 3,859,586 | 1/1975 | Wadlington | 363/25 X |
| 4,134,057 | 1/1979 | Portmann | 368/205 X |
| 4,291,266 | 9/1981 | Portmann | 368/205 X |

FOREIGN PATENT DOCUMENTS

| | | | |
|---|---|---|---|
| 616044 | 3/1980 | Switzerland | 368/205 |

OTHER PUBLICATIONS

IBM Technical Disclosure Bulletin, "Synchronous Switching Regulator", Milewski, vol. 20, No. 11A, Apr. 1978.

IBM Technical Disclosure Bulletin, "Transistor Rectifier-Regulator", Gillett, vol. 22, No. 6, Nov. 1979.

Rosler, "Step-Motor Switching Regulator with VMOS Transistors", Elektronik, vol. 28, No. 7, Apr. 1979.

*Primary Examiner*—B. A. Reynolds
*Assistant Examiner*—Philip H. Leung
*Attorney, Agent, or Firm*—Michael Ebert

[57] ABSTRACT

A d-c converter for inclusion in a miniature electronic device, such as an electronic wristwatch having a d-c supply source, the converter functioning to increase or decrease the voltage of this source. The converter includes a transformer whose primary is connected to the source through a periodically-actuated chopper to produce an alternating voltage, the secondary of the transformer being connected to a rectifier circuit having at least one controllable switch element whose on-off state is governed in synchronism with the chopper whereby the switch element acts to rectify the secondary voltage.

15 Claims, 2 Drawing Figures

D-C VOLTAGE CONVERTER FOR A WRISTWATCH

BACKGROUND OF INVENTION

Figure 1:
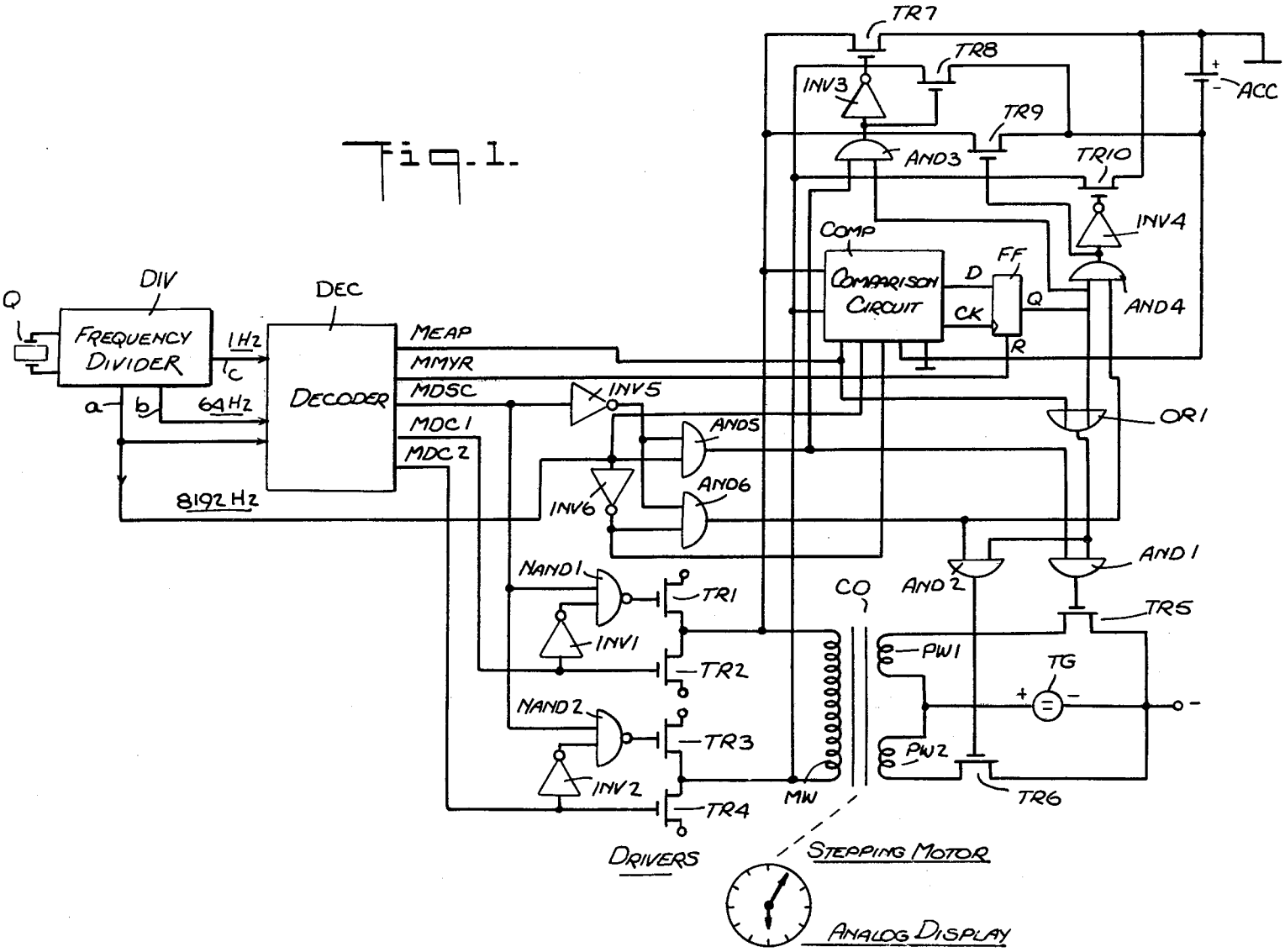

This invention relates generally to d-c voltage converters, and more particularly to electronic watches or other miniature electronic devices provided with a d-c voltage source and a voltage converter adapted to increase or reduce the voltage thereof.

By the expression "miniature electronic device" as used herein is meant a battery-operated instrument or apparatus whose dimensions are so small that it can be carried about, the power consumption thereof being very slight. It is desirable that a device of this type include a compact d-c voltage converter unit having the smallest possible energy losses. A typical example of such a miniature electronic device is an electronic wristwatch. Other examples are digital-display thermometers and monitoring instruments which can be carried on the body such as pulse-rate meters or other small biomedical apparatus. Also included are miniature computers or the like. In general, the concern of the present invention is with miniaturized electronic devices in which, for some reason, the available d-c supply voltage must be increased or reduced with a minimum of losses.

Thus digital display instruments are known in which the voltage of the supply battery, usually amounting to 1.5 volts, is stepped up in order to actuate a display system having liquid-crystal or other electro-optical elements.

The problem of converting a d-c voltage in a manner maintaining high efficiency is particularly acute in those situations where only one low voltage power supply source is available in a miniature electronic device. Thus if the energy for operating a wristwatch is generated by thermal elements that exploit the temperature difference between the back of the watch case, which is warm when worn, and the colder outer part of the case which is insulated thermally from the back, the voltage produced thereby is minute. Even using a large number of such thermal elements connected in series, the resultant d-c voltage will still be at a very low level.

It is necessary, therefore, to step up the available d.c. supply voltage by converter means including a chopper, a transformer and a rectifier. The principle of converting a d-c voltage in this manner is well known, the alternating voltage induced in the secondary winding of the transformer being rectified by means of selenium cells, silicon diodes or the like. A converter arrangement of this type is disclosed in the Sutter application Ser. No. 968,694, filed Dec. 12, 1978 (now U.S. Pat. No. 4,214,434), whose entire disclosure is incorporated herein by reference.

It has been found, particularly in the case of thermoelectrically-operated wristwatches or other modern microelectronic devices, that rectification by means of diodes has fundamental disadvantages. Even in the case of integrated diodes, diodes characteristically have a threshold voltage of at least about 0.5 to 0.6 volts. This means that the diode conducts practically no current as long as the voltage applied to it is below this critical value. In the case of an electronic watch requiring a d-c voltage of 1.5 volts for the operation of the electronic circuits and of the stepping motor or digital display system, when this watch is powered by thermal elements or solar cells, one is compelled, when using diodes in the d-c converter to produce an alternating voltage having almost twice the voltage that would have been necessary had the diodes been responsive at much lower voltages.

The unfavorable ratio of diode threshold value to the required d.c. voltage (i.e., the d-c voltage that must be available at the output of the d-c voltage converter) in rectifier circuits for miniature electronic devices gives rise to a number of serious disadvantages. Since possibly more than one-half of the power given off by the voltage transformer is wasted as loss power in the diodes, a relatively large voltage transformer is required whose secondary winding must have a large number of turns. By reason of this requirement, the internal resistance of the secondary winding it also correspondingly increased.

Moreover, the need for a large step-up ratio reduces the efficiency of the transformer because of less favorable coupling factors. Aside from the concomitant increase in volume and the rise in the cost of the transformer, is the disturbing fact that in many cases the source of available d.c. supply voltage is excessively loaded so that the power yielded by the rectifier may be altogether insufficient to operate the device or the components of the device which are powered by the converted d-c voltage. Finally, with a large ratio of diode threshold voltage to rectifier output voltage, irregularities in the characteristics of the diodes as well as the dependence of their threshold value on the temperature adversely affect the stability or constancy of the rectified voltage.

The above-identified drawbacks militate against the production of an electronic miniature device whose operation is reliable and efficient.

SUMMARY OF INVENTION

In view of the foregoing, the main object of this invention is to provide a d-c converter which overcomes the above-noted difficulties.

Briefly stated, in a converter in accordance with the invention, this object is realized in a rectifier circuit having at least one controllable switch element whose on-off state is governed by the means controlling the operation of the chopper or in synchronism with the chopper whereby the switch element acts to rectify the transformed voltage.

Based on this novel approach, one can, for instance, rectify the transformed alternating voltage which may be sinusoidal in form or consist of a train of pulses of opposite polarity, by means of integrated MOS field effect transistors controlled directly by a synchronization circuit containing logic elements, which circuit also controls the chopper. However, a pulse train serving to control the transistors which effect rectification or to control other components acting as controllable switch elements could also be derived directly from the chopper to bring about the synchronism between the chopper and rectifier necessary for dependable and substantially loss-free operation.

In lieu of transistors, use may be made in certain circumstances of controllable switch elements of a different type, such as integrated microswitches actuated by an electrical field. Microswitches of this type are already known which can form part of an integrated circuit and can be manufactured in accordance with the techniques customary for integrated circuits (conventional photolithographic and IC-process techniques). Such switches have a principal dimension of less than 0.1 mm and can consist essentially or a metal-coated silicone-dioxide blade and a mating contact.

Because rectification of the alternating voltage derived from the voltage transformer is not effected in the d-c converter in accordance with the invention by diodes but by means of switch elements which operate in synchronism with the chopper, the converter circuit can now function efficiently with a low d.c. voltage. While this unavoidably entails an additional number of control elements, this is not a significant drawback; for these components consume extremely little energy and can be integrated at low cost on the same chip as the other circuit elements of the miniature device (at least on the same chip as the circuit components of the chopper circuit).

As compared with this insignificant disadvantage, there are substantial advantages; i.e., a more compact and less expensive voltage transformer, a reduction in power losses and a more constant d-c converter output voltage. These advantages are conducive to further miniaturization in keeping with the modern trend toward the manufacture of reliable and efficient electronic devices of the smallest possible size with minimal current consumption.

In certain cases it is advantageous or even necessary to connect a buffer accumulator in parallel with the output terminals of the d-c voltage converter. In order to prevent discharge of the accumulator when the output voltage of the converter is insufficient, it is advisable that a converter in accordance with the invention be equipped with a special detection or comparison circuit that disables the d-c voltage converter or interrupts the connection between the rectifier circuit and the accumulator as long as the voltage supplied to the converter by the d-c voltage source or an electric variable dependent thereon lies outside a given range or exceeds a predetermined value in the positive or negative direction.

OUTLINE OF DRAWINGS

Figure 2:
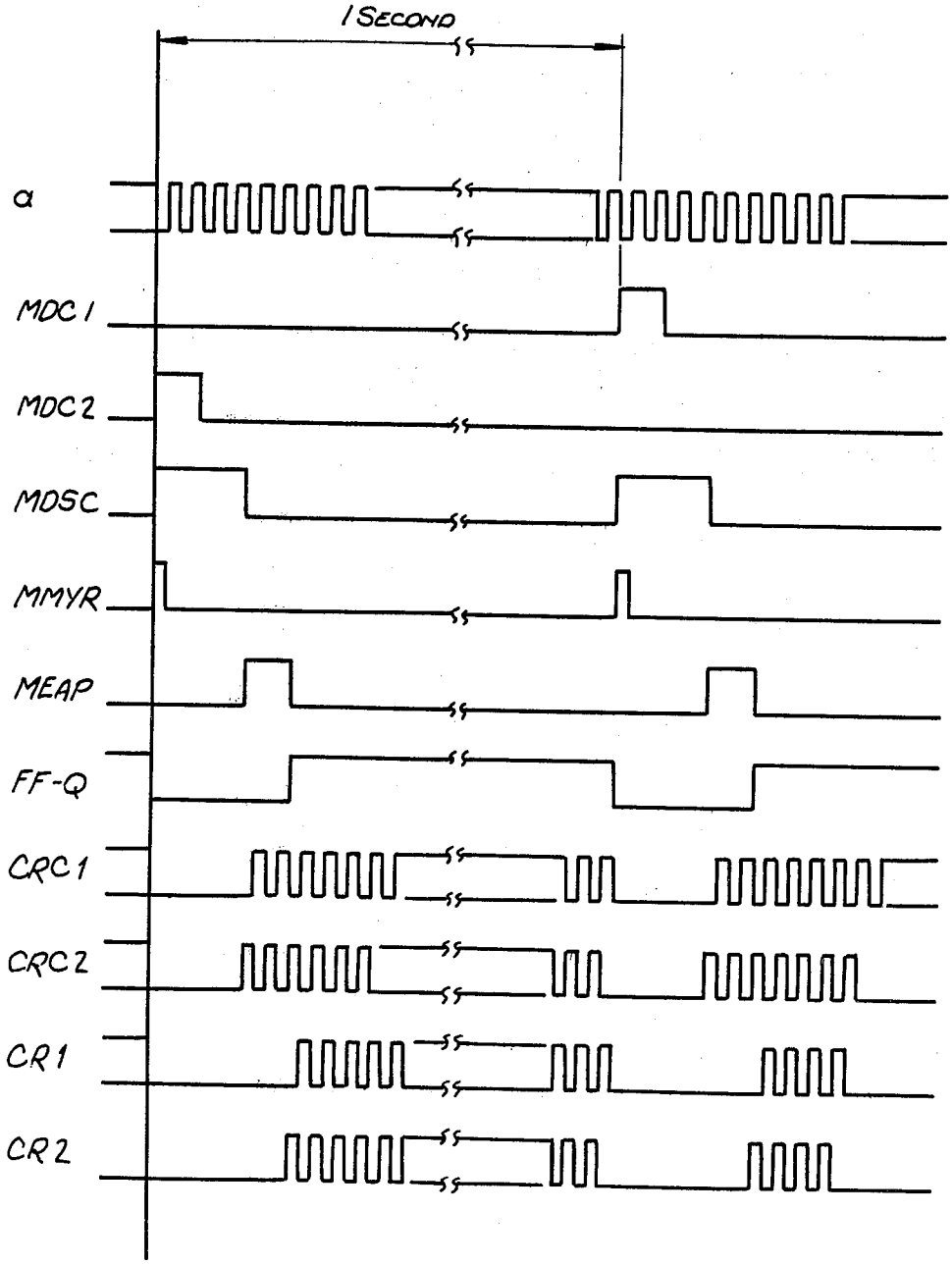

For a better understanding of the invention as well as other objects and further features thereof, reference is made to the following detailed description to be read in conjunction with the accompanying drawings, wherein:

FIG. 1 is a partially simplified circuit diagram of an electronic watch having an analog digital display and a thermogenerator power source, the watch including a d-c voltage converter in accordance with the invention associated with the thermogenerator; and FIG. 2 is a pulse timing diagram illustrating the operation of the converter circuits.

DESCRIPTION OF INVENTION

The Converter Circuit

The embodiment illustrated deals with an electronic watch having an analog display in the form of moving hands driven by a stepping motor. The power source for the clock is a thermogenerator having a relatively large number of thermoelements, this generator exploiting the temperature difference between the wrist on which the watch is worn and ambient temperature. It will, however, be appreciated that the d-c converter disclosed herein can be used with other forms of miniature electronic devices.

The electronic watch shown diagrammatically in FIG. 1 is provided with a time base or frequency standard including a quartz crystal Q whose frequency is, for instance, 32768 Hz. A frequency divider DIV reduces the time base frequency to 1 Hz (output c). At output a of the divider a signal having a frequency of 8192 Hz is extracted, while the frequency at output b is 64 Hz. These three frequency divider outputs feed a decoding circuit DEC which, by means of conventional logic switch means, defines different time intervals (length of the motor drive pulses, duration of the short circuiting of the motor stator winding, detection intervals of the comparison circuit).

The hands of the clock are driven by a bipolar stepping motor whose stator winding MW is fed via MOS-FET driver transistor TR1-TR4. The control of these transistors is effected by decoding circuit DEC via NAND gates NAND1 and NAND2 as well as inverters INV1 and INV2.

Stator winding MW at the same time carries out the function of the secondary winding of a voltage transformer. This transformer also comprises an elongated ferromagnetic core CO as well as a pair of primary windings PW1 and PW2. In practice, a single primary winding having a center tap may be used for the same purpose. The center tap is connected to the positive pole of the thermogenerator TG. Between the negative pole of generator TG and the end connections of the primary windings PW1 and PW2 are the source and drain connections of two MOS-FET chopper transistors TR5 and TR6 controlled in push-pull relation via AND gates AND1 and AND2. Because thermogenerator TG produces an extremely small voltage, the voltage transformer must have a comparatively high step-up ratio when used in the context of an electronic watch.

The alternating voltage induced in secondary winding MW must be rectified in order to energize the electronic circuits of the watch. For this purpose, there are present, instead of conventional diodes, four MOS-FET switch transistors TR7 to TR10 which together form a full-wave rectifier whose output is connected directly to a buffer accumulator ACC. The function of accumulator ACC is to power the watch circuits when the voltage produced by thermogenerator TG drops below a given level (for instance, the watch is temporarily not worn on the wrist). In addition, accumulator ACC serves as a source of supply current for the duration of certain short intervals, and in particular for feeding the motor stator winding MW with drive pulses.

The chopper transistors TR5 and TR6 (via AND1 and AND2) and the switch transistors TR7 to TR10 (via AND3, INV3 as well as AND4, INV4) are controlled synchronously by the AND gates AND5 and AND6. These, in turn, are connected to inverters INV5 and INV6.

If no special measures were taken, then accumulator ACC could discharge via the transistors TR7 to TR10 and the winding MW if the voltage supplied by the rectifier were to drop below the level of the accumulator voltage. For this reason a comparison circuit COMP is provided to whose input is applied the voltage induced in the winding MW and whose output determines the state of a flip-flop FF. Flip-flop FF has three inputs; namely D (data), CK (clock) and R (reset), as well as an output Q.

Comparison circuit COMP acts, so to speak, as a detection circuit which rectifies the voltage taken from secondary winding MW and compares it with the voltage of accumulator ACC. An OR gate OR1 activates or blocks chopper transistors TR5 and TR6, depending on the state of its inputs.

Operation

The converter circuit described above operates in the following manner:

From the pulse timing diagram of FIG. 2, one can see in connection with the output designations of decoder circuit DEC that every second this circuit yields a pulse MDSC whose length is about 20 ms. Furthermore, every second an MDC1 pulse or an MDC2 pulse, each having a duration of about 10 ms., alternately appears. The 8192 Hz pulse trains at the output a of the divider are shown in FIG. 2 on a different time scale for greater clarity. That is to say, the length of the 8192 Hz pulses has been stretched 40 times as compared to the other pulses.

Let us assume that by suitable coincidence of the pulse trains fed to the inputs of the decoder circuit DEC, a pulse MDC2 is first produced. As a result, n-channel transistor TR4 becomes conductive. Although a pulse also appears simultaneously at the MDSC output, p-channel transistor TR3 cannot conduct, for no signal appears at the output of inverter INV2; hence the signal yielded at the output of the NAND2 gate blocks this transistor. As a further consequence (see FIG. 2), p-channel transistor TR1 passes into the conductive state, while TR2 (n-channel) remains blocked.

In this way, stator winding MW receives a drive pulse whose duration corresponds to the length of pulse MDC2. In an analogous manner, transistors TR2 and TR3 are rendered conductive and transistors TR1 and TR4 are blocked as soon as an MDC1 pulse is yielded. This means that at the beginning of the next second the motor receives a drive pulse of opposite polarity.

It is to be noted in the timing diagram that every second an MDSC pulse is yielded by decoder DEC, beginning with the motor control pulse MDC1 or MDC2 but lasting about 20 ms. Pulse MDSC is applied to one input of both gates NAND1 and NAND2. As a consequence, after each motor pulse that, for a period of about 10 ms., transistors TR1 and TR3 conduct and transistors TR2 and TR4 block (short-circuit interval). In the interval between two MDSC pulses, all drive transistors TRL-TR4 remain blocked.

The a-output of frequency divider DIV, which takes the form of 8192 Hz pulses, is applied via inverter INV6 to one input of both gates AND5 and AND6. This means that an 8192 Hz pulse series is yielded in phase opposition by the outputs of these gates as long as no MDSC pulse is present. These pulses are indicated in the diagram of FIG. 2 by CRC1 and CRC2 (chopper and rectifier control).

The pulses CRC1 (from AND gate AND5) as well as pulses CRC2 (from AND gate AND6) serve, on the one hand, to control chopper transistors TR5 and TR6 (via AND gates AND2 and AND1) and, on the other hand, to control transistors TR7 to TR10 which effect rectification of the alternating voltage induced in the winding MW (via AND3 and INV3, and AND4 and INV4, respectively). This serves to bring about synchronous operation of the chopper and rectifier. Of course, in this connection the input of the rectifier must be so connected with the terminals of the secondary winding that the polarity of the DC voltage at the rectifier output is consistent with that of accumulator ACC.

Because the 8192 Hz pulses are fed in phase opposition to AND gates AND2 and AND1, chopper transistors TR5 and TR6 operate in push-pull to assure maximum utilization of the energy given off by the thermogenerator. This is also the reason why full-wave rectification takes place. To be sure, for reasons explained further below, rectification only takes place as long as a signal is present at output Q of the flip-flop FF. From the logic function of AND3 and INV3, a conductive condition of the p-channel transistor TR7 and of the n-channel transistor TR8 is produced when an 8192 Hz pulse is present at an input of gate AND3 (and at the same time the FF output Q gives off a signal). Transistors TR9 and TR10 controlled by gate AND 6 and gate AND4 operate in phase opposition with transistors TR7 and TR8. The pulse trains yielded by the outputs of gates AND3 and AND4 are shown in the pulse diagram and bear the designations CR1 and CR2, respectively.

It would be possible by a continuous monitoring of the voltage given off by thermogenerator TR and by a determination of the ratio between this voltage and the voltage of the accumulator ACC, to effect a continuous comparison in order to put the rectifier out of operation in the event of insufficient thermogenerator voltage. One could, however, carry out this monitoring process by another electric variable dependent directly or indirectly on the thermogenerator voltage, such as a positive or negative rise above a predetermined threshold by the current flowing between rectifier and buffer accumulator and/or the direction thereof.

In the present example, such a comparison procedure takes place periodically; namely, once per second for the duration of the MEAP measurement pulse yielded by decoding circuit DEC. This measurement pulse is in each case transmitted directly after the end of the MDSC pulse to comparison circuit COMP and has a duration of about 10 ms, as shown in the timing diagram. For the duration of this measurement, the detection and comparison circuit COMP determines the ratio between the voltage of accumulator ACC and a d-c voltage obtained by rectification of the alternating voltage produced in the winding MW, and it activates flip-flop FF so that a signal appears at the output Q, provided that the voltage which is derived from the thermogenerator via the transformer and rectifier lies within a given range or exceeds it by a certain amount. This depends on the accumulator voltage.

One could, however, also effect the comparison with a reference voltage stabilized by a zener diode. The flip-flop FF is in each case reset at the start of an interval of one second by a pulse MMYR (memory reset), also derived from decoding circuit DEC. This results from the fact that flip-flop FF remains reset for the entire duration of pulse MDSC as well as of the adjoining measurement pulse MEAP, as indicated by the course of voltage FF-Q in the timing diagram.

OR gate OR1 sees to it, via gates AND2 and AND1, that the chopper operates as long as flip-flop FF is set. Furthermore, the chopper remains in operation for the duration of the measurement interval; for the measurement pulse output MEAP of decoder DEC is applied to an input of gate OR1.

The output Q of flip-flop FF is applied to one input of both gates AND3 and AND4. Hence with flip-flop FF reset, no 8192 Hz pulses can be transmitted to the gates of transistors TR7 to TR10. These transistors of the rectifier which operate as switch elements then remain blocked.

Flip-flop FF is therefore always set—aside from the corresponding 30 ms section (see diagram FF—Q)—unless the indirectly detected thermogenerator voltage lies below a given minimum value. As long as this flip-flop is set, the chopper and rectifier remain in operation. If it is found within a measurement interval lasting for 10 ms that the thermogenerator voltage or the output voltage of the rectifier which is dependent thereon is too low (which creates the danger of a discharge of the accumulator through the rectifier), then flip-flop output Q remains without signal, as a result of which the chopper and rectifier remain passive, at least until the next measurement interval and the entire energy for the operation of the watch is taken from accumulator ACC. The detection or comparison process (measurement interval) is repeated every second. As already mentioned, the chopper is actuated in any event by 8192 Hz pulses during the measurement interval.

In the pulse diagram of FIG. 2, it has been assumed that a setting of flip-flop FF takes place after each measurement pulse MEAP; i.e., after each measurement interval. There have not been graphically shown the pulse relationships which occur if the MW voltage detected by the comparison circuit COMP does not reach the minimum value and flip-flop FF remains reset after termination of the measurement interval. In such a situation, no 8192 Hz control pulses CR1 and CR2 can be transmitted to the rectifier until comparison circuit COMP again activates flip-flop FF. Furthermore, CRC1 and CRC2 pulses will be transmitted to the chopper only during the short measurement intervals. The disconnection of the rectifier transistors and the chopper for the duration of an insufficient voltage supply has a favorable effect on the energy conservation characteristics of the circuit.

While there has been shown and described a preferred embodiment of a d-c voltage converter in accordance with the invention, it will be appreciated that many changes and modifications may be made therein without, however, departing from the essential spirit thereof.

I claim:

1. An electronic wristwatch provided with a low voltage d-c supply source and an electronic circuit having a high-frequency time base whose output is coupled to a multi-stage frequency divider whose output stage yields low-frequency timing pulses to actuate a time display, and a converter which functions to increase the voltage of the source to a level sufficient to energize the electronic circuit, said converter comprising:

(A) a transformer having a primary and a secondary;

(B) a periodically-actuated chopper interposed between the source and the primary whereby an a-c voltage is induced in the secondary;

(C) a rectifier circuit connected to the secondary and having at least one controllable switch element; and (D) means to derive intermediate frequency pulses from an intermediate stage of the divider to govern the on-off state of said switch element in synchronism with the periodically-actuated chopper to cause said element to effect rectification of the a-c voltage.

2. An electronic watch as set forth in claim 1, wherein said switch element is a transistor.

3. An electronic watch as set forth in claim 2, wherein said rectifier circuit includes a plurality of transistors in a full-wave rectifier network, each transistor functioning as a switch element.

4. An electronic watch as set forth in claim 3, wherein said plurality is constituted by four MOS-FET transistors.

5. An electronic watch as set forth in claim 1, wherein said switch element is a field-controlled integrated-circuit microswitch.

6. An electronic watch as set forth in claim 1, further including an accumulator coupled to the output of said rectifier circuit and charged thereby.

7. An electronic watch as set forth in claim 6, further including a comparator responsive to the voltage of said d-c source and adapted to disable the converter when the voltage supplied by said source lies outside a given range.

8. An electronic watch as set forth in claim 6, further including a comparator responsive to the voltage of said d-c source and adapted to disconnect said accumulator from the rectifier circuit when the voltage supplied by said source lies outside a given range.

9. An electronic watch as set forth in claim 1, wherein said wristwatch has a case provided with a metal part that makes contact with the wrist of the wearer, said d-c source being constituted by a thermogenerator having positive and negative poles, one of which is thermally coupled to said metal part.

10. An electronic watch as set forth in claim 9, wherein said transformer primary has a centertap and the other pole of said thermogenerator is connected to the centertap of said transformer primary and the one pole is connected to the ends of the primary through respective controllable switch elements, said intermediate frequency pulses derived from said frequency divider acting to actuate said elements in push-pull.

11. An electronic watch as set forth in claim 10 having a stepping motor provided with a rotor for driving the hands of an analog time display, said motor having a stator winding which also functions as the secondary of said transformer.

12. An electronic watch as set forth in claim 11, further including a decoder activated by said frequency divider and functioning to define the duration of said timing pulses for driving the stepping motor, the interval between successive driving pulses being short relative to the duration of the driving pulses, and means to short circuit said stator winding during said interval.

13. An electronic watch as set forth in claim 12, further including a comparator responsive to the level of voltage supplied by said source, and logic control means coupled to said comparator to disable said rectifier circuit switch element when said voltage level is insufficient.

14. An electronic watch as set forth in claim 13, wherein said rectifier circuit includes four transistors acting as switch elements in a full-wave rectification network, and said chopper is constituted by a pair of controllable switch elements.

15. An electronic watch as set forth in claim 14, wherein said logic control means coupled to said comparator acts via a flip-flop to disable said rectifier circuit transistors and said chopper switch elements when said voltage level is insufficient.

* * * * *